US006837725B1

(12) United States Patent
Gordon et al.

(10) Patent No.: US 6,837,725 B1
(45) Date of Patent: Jan. 4, 2005

(54) CONNECTOR ASSEMBLY

(75) Inventors: David Scott Gordon, Hillsboro, ND (US); Michael Ray Schlichtmann, Fargo, ND (US); Jon Thomas Jacobson, Fargo, ND (US); Ronald Gene Landman, Fargo, ND (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 10/758,727

(22) Filed: Jan. 16, 2004

(51) Int. Cl.[7] ..... H01R 29/00
(52) U.S. Cl. ..... 439/188; 439/489; 200/51.1
(58) Field of Search ..... 439/188, 489; 200/51.1

(56) References Cited

U.S. PATENT DOCUMENTS

| | | | | | |
|---|---|---|---|---|---|
| 4,438,303 | A | * | 3/1984 | Astier | 200/51.1 |
| 5,181,858 | A | | 1/1993 | Matz et al. | 439/188 |
| 5,374,200 | A | | 12/1994 | Giroux | 439/188 |
| 5,435,748 | A | * | 7/1995 | Abe | 439/489 |
| 5,836,785 | A | | 11/1998 | Lee | 439/505 |
| 5,944,547 | A | * | 8/1999 | Golab et al. | 439/188 |
| 6,452,402 | B1 | | 9/2002 | Kerai | 324/538 |
| 6,509,659 | B1 | | 1/2003 | Carroll et al. | 307/125 |
| 6,528,900 | B1 | * | 3/2003 | Serizawa et al. | 439/34 |
| 6,540,534 | B2 | * | 4/2003 | Vo et al. | 439/188 |
| 2004/0127082 | A1 | * | 7/2004 | Leighton | 439/188 |

* cited by examiner

*Primary Examiner*—Tho D. Ta

(57) ABSTRACT

An electrical connector assembly has first and second connector units which are connectable with each other. One of the connectors has a shell which has a variable number of tabs projecting therefrom. The number and position of the tabs can be selected so that different connectors can be distinguished from each other. A set of switches are mounted on a base adjacent the other connector. The switches are engagable tabs so that the status of the switches represents the number and position of the tabs, thereby generating electrical signals uniquely identifying the connectors.

11 Claims, 3 Drawing Sheets

CONNECTOR ASSEMBLY

BACKGROUND

The present invention relates to an electrical connector assembly, and more particularly to a connector assembly which includes parts which embody information pertaining to the identity of particular electrical components.

Modern vehicles are provided with a variety of electrical components, each of which must be connected to a vehicle electronic control unit (ECU). Each electrical component is normally connected to the ECU by an electrical connector which has a plurality of conductive sockets which engage corresponding connector pins which are electrically connected to the ECU. Information regarding which components are connected and which pins are associated with which component signals or functions must be programmed into the ECU.

This has been accomplished at the end of the production line by programming an input/output map corresponding to each component configuration into the ECU or by maintaining a large number of different ECU programs, and providing the ECU with a program corresponding to each component configuration. This is undesirable because it is complex and costly to create and maintain input/output maps with an off-line tool. It is undesirable and costly to program ECUs at the end of the production line, and this requires a programming station which occupies valuable space in the production facility. If different ECU part numbers are used, then they have to be sequenced to match each vehicle, and this adds complexity and cost to the production system. Such solutions also increase the complexity of end of line test systems and processes, increase the difficulty and duration of troubleshooting issues, and increase the complexity of service tasks due to the variation from one vehicle to the next.

Another solution would be to provide all the ECUs with a standard program which is capable of adapting itself depending upon what components are connected to the ECU. However, this would require a system or method for providing component identifying information to the ECU.

A commercially available connector manufactured by Delphi Automotive Systems includes an outer cover and an inner socket body which receives the conductive sockets. This connector also includes a hollow tub-shaped shell which is mounted over an end of the inner socket body. But, this connector does not include any features by which different connectors can be distinguished from each other.

SUMMARY

Accordingly, an object of this invention is to provide an electrical connector assembly which includes features for communicating component identifying information to an ECU.

A further object of the invention is to provide an electrical connector assembly which includes features by which different connectors can be distinguished from each other.

These and other objects are achieved by the present invention, wherein an electrical connector assembly has first and second connector units which are connectable with each other. One of the connectors has a shell which has a selectable number of tabs projecting therefrom. The number and position of the tabs can be selected so that different connectors can be distinguished from each other. A set of switches are mounted on a base adjacent the other connector. The switches are engagable by the tabs so that the status of the switches represents the number and position of the tabs, thereby generating electrical signals uniquely identifying the connectors.

DETAILED DESCRIPTION

Figure 1:
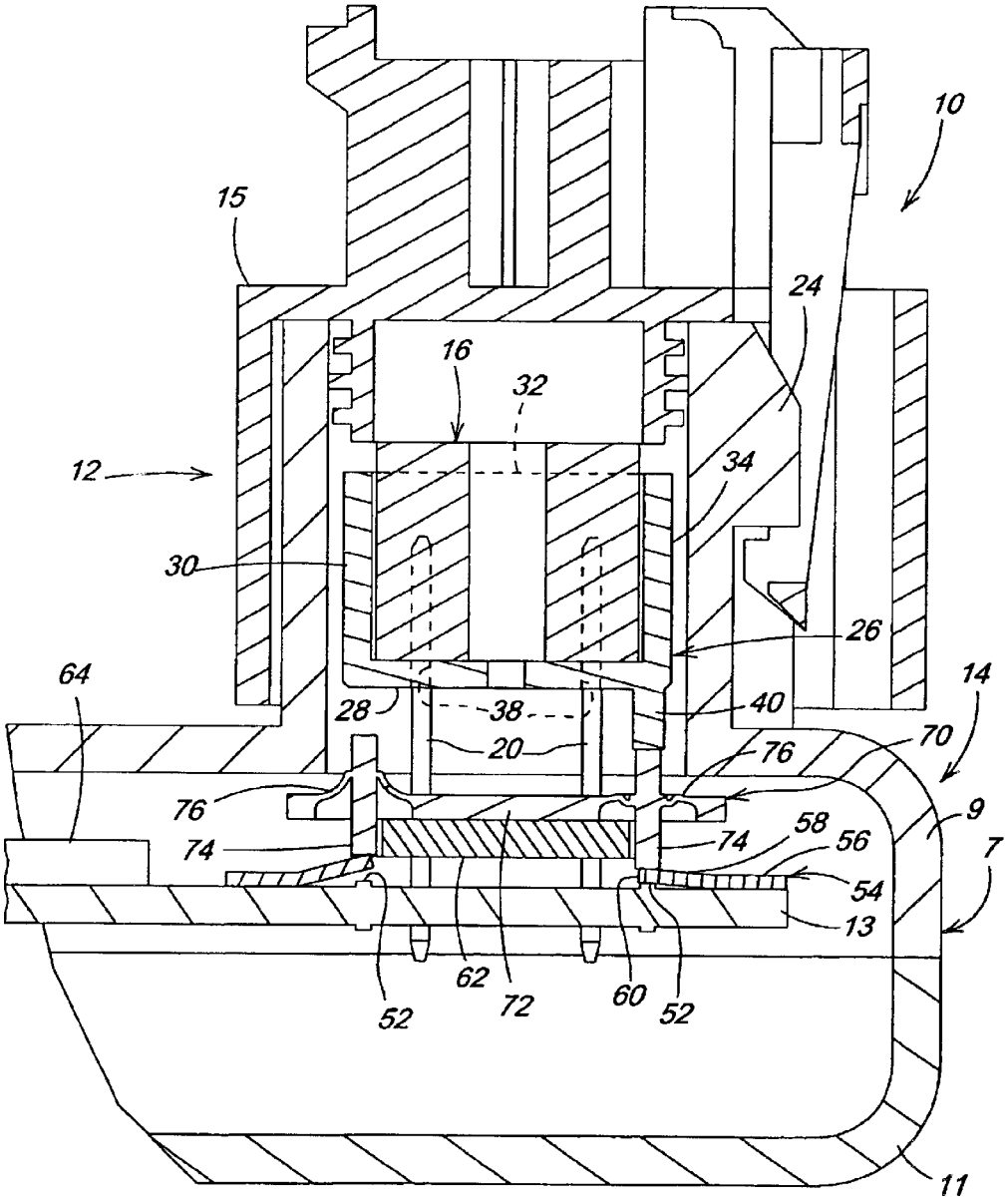
FIG. 1 is a sectional view of a connector assembly according to the present invention.
Figure 2:
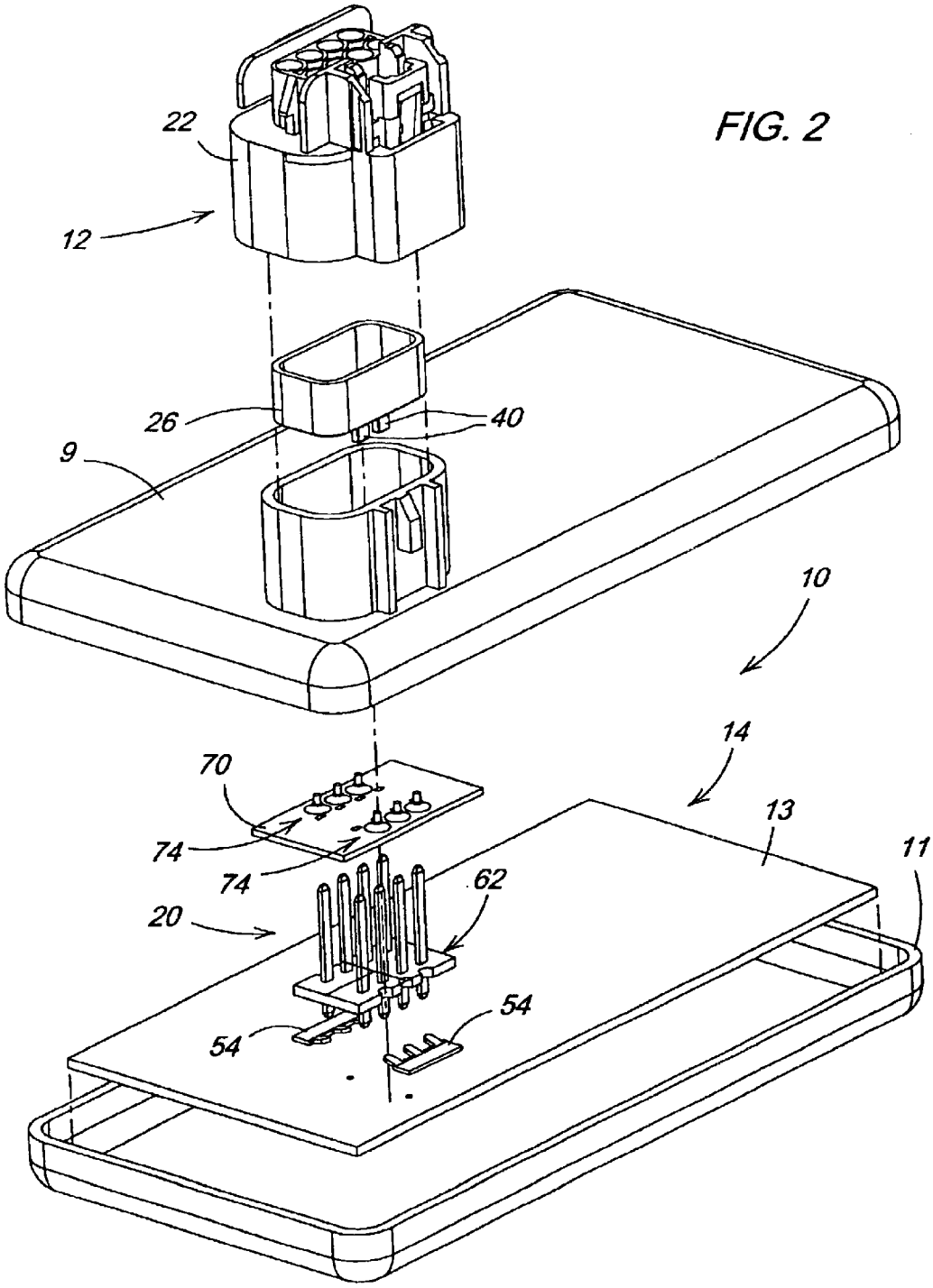
FIG. 2 is an exploded perspective view of the connector assembly of FIG. 1.
Figure 4:
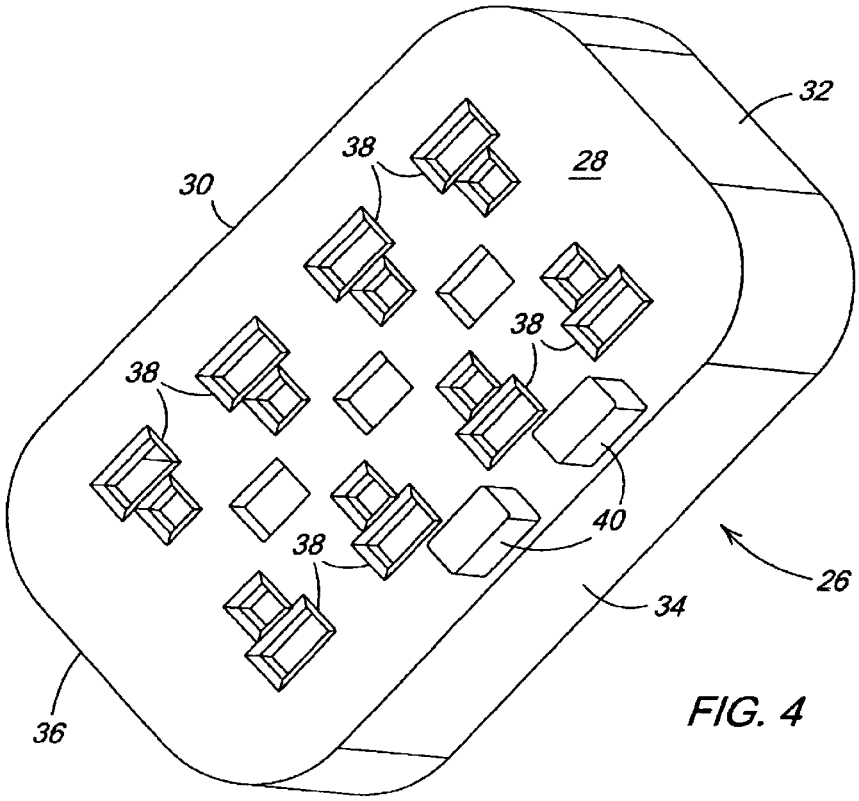
FIG. 4 is a perspective view of the nose piece of FIGS. 1 and 2.

Referring to FIGS. 1 and 2, connector assembly 10 includes a first connector 12 for mating with a second connector 14. Connector 14 includes a housing 7 with upper part 9 and lower part 11 which enclose a conventional circuit board 13. As best seen in FIG. 1, connector 12 includes an integral outer housing or cover 15 and socket housing 16. Socket housing receives a plurality of conventional conductive sockets (not shown) for receiving and mating with a corresponding plurality of pins 20 of connector 14. Outer housing 15 receives and lockingly engages an inner housing 24 of the connector 14. Referring to FIGS. 1, 2 and 4, connector 12 also includes a nose piece 26. Nose piece or shell 26 is tub-shaped with a bottom wall 28 and four side walls 30, 32, 34 and 36. Bottom wall 28 has a plurality of openings 38, each receiving a corresponding one of the pins 20. The structure described so far is conventional and is commercially available from Delphi Automotive Systems. According to the present invention, a selected number of nubs 40 project away from the bottom wall 28 of the nose piece 26. and in the illustrated example, two nubs 40 project therefrom as best seen in FIGS. 1, 2 and 4. Both the number and position of the nubs 40 can be varied and selected so that different nose pieces can have different, unique arrangements of nubs 40.

The connector 14 is preferably mounted to circuit board 13 which receives the pins 20. The circuit board 13 includes conventional metallic conductors and metallic surface strips or traces (not shown) which are electrically connected to the pins 20. A plurality of conductive switch contacts 52 are spaced apart and mounted on the surface of the board 13 adjacent to the pins 20. A corresponding plurality of flexible switch members 54 are mounted on the board 13. Each switch member 54 includes a first leg 56 fixed to the surface of the board 13 and a second conductive leg 58 which projects away from the first leg 56 to an end 60 which is normally spaced apart above and adjacent to a corresponding one of the switch contacts 52. A rigid pin support part 62 receives the pins 20 and holds them in proper orientation. A microprocessor 64 is preferably mounted on the board 13 and electrically connected with the pins 20 and with the switches 54 by conventional conductive strips (not shown) on the board 13.

Figure 3:
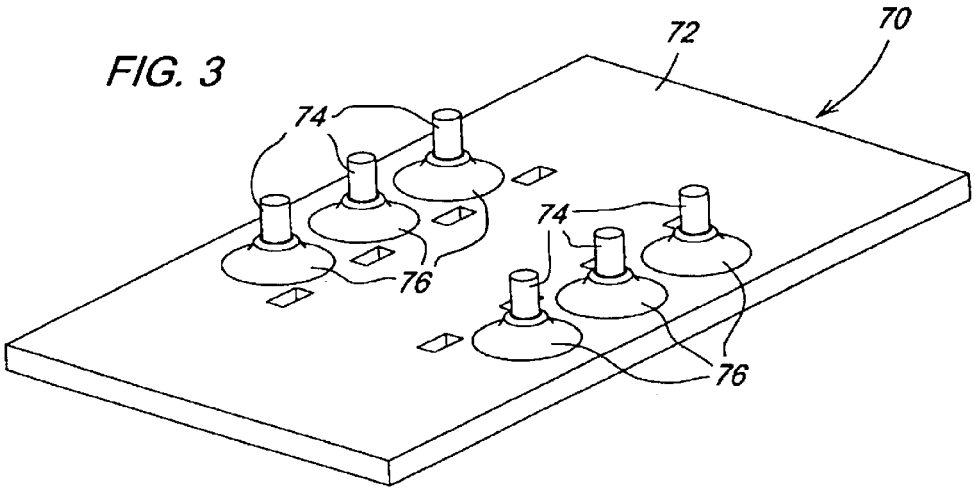
FIG. 3 is a perspective view of the flexible pad of FIGS. 1 and 2.

Referring to FIGS. 1, 2 and 3, connector 14 also preferably includes a flexible pad 70 adjacent to part 62 and between part 62 and nose piece 26. Pad 70 includes a flat flexible rectangular body 72 and a plurality of rod-shaped pieces 74, each rod corresponding to one of the switches 54. The rods 74 project outwardly from both sides of the body 72. The pad 70 also includes a plurality of flexible web portions 76 which flexibly couple the rods 74 to the body 72.

The web portions 76 are biased to urge the rods away from the switches 54 and towards the nose piece 26. Alternatively, the flexible pad 70 can be eliminated if the nubs 40 are made long enough to directly engage the switches 54.

As best seen in FIG. 4, for example, on one side of the nose piece 26, no nubs 40 are present, and two nubs 40 are present on the other side. Referring again to FIG. 1, the left side rods 74 do not engage any nubs 40, and these rods are held by the webs 76 in an inactive position wherein the legs 58 of the corresponding switches 54 are spaced apart from the corresponding switch contacts 52. The two right side nubs 40 engage two corresponding rods 74 and move these rods 74 downward against the bias of web portions 76 to an active position wherein the rods 74 depress the legs 58 of the corresponding switches 54 into engagement with the corresponding switch contacts 52.

The number, location and presence or absence of the nubs 40 will determine the number and which of the switches 54 are activated when connector unit 12 is mated with connector unit 14, and the switches 54 function as sensors which sense the absence or presence of the nubs 40. With, for example, 6 switches 52 and 6 possible nubs 40, the assembly 10 is capable of identifying 26 or 64 different unique connectors or components. With, N number of switches 52 and N possible nubs 40, the assembly 10 is capable of identifying $2^N$ different unique connectors or components. Thus, different first connector units 12 can be distinguished from each other by mounting thereon different unique nose pieces 26 with different numbers and combinations of nubs 40 thereon. This results in a unique pattern of actuation of the switches 54 for each unique nose piece 26. The pattern of actuated switches 54 can be read by the microprocessor 64 which can then adapt its stored program in response to the actuation status of switches 52. A nose piece with zero nubs can also represent a unique connector 12. Thus, different unique connectors can be used to connect different components to an electronic control unit, and to provide the electronic control unit with unique signals corresponding to the different components.

While the present invention has been described in conjunction with a specific embodiment, it is understood that many alternatives, modifications and variations will be apparent to those skilled in the art in light of the foregoing description. Accordingly, this invention is intended to embrace all such alternatives, modification and variations which fall within the spirit and scope of the appended claims.

We claim:

1. An electrical connector assembly having a first connector unit having a plurality of conducting sockets and a second connector unit having a plurality of conducting pins for mating engagement with the sockets, characterized by:

a selectable number of projecting members coupled to one of the connector units; and a plurality of sensors coupled to the other of the connector units, the sensors being operatively engagable with the projecting members when the first connector unit is mated with the second connector unit, the sensors sensing absence and presence of the projecting members and generating signals indicative thereof.

2. The connector assembly of claim 1, wherein:

the sensors comprise a plurality of electronic switches, each switch closing when engaged by one of the projecting members.

3. The connector assembly of claim 1, wherein:

the selectable number is zero.

4. The connector assembly of claim 1, wherein:

the sensor units comprise a plurality of electronic switches mounted on a circuit board;

the first connector unit includes a socket member adapted to carrying a plurality of conducting sockets; and a nose piece mountable on the socket member, the selectable number of projecting members projecting form a surface of the nose piece.

5. The connector assembly of claim 1, wherein:

one of the connector units includes a socket body; and a hollow nose piece is mounted over one end of the socket body, the projecting members project from the nose piece.

6. The connector assembly of claim 5, wherein:

the nose piece which receives at least a portion of the socket body.

7. The connector assembly of claim 5, further comprising:

a flexible pad positioned between the switches and the nose piece, the pad comprising a body and a plurality of rods, each rod corresponding to one of the switches, projecting outwardly from both sides of the body and being flexibly coupled to the body by a corresponding flexible web portion.

8. The connector assembly of claim 7, wherein:

the web portions are biased to urge the rods away from the switches and towards the nose piece.

9. The connector assembly of claim 7, wherein:

the pad includes a plurality of opening therein, the pins extending through said openings.

10. An electrical connector assembly comprising:

first and second connector units which are connectable with each other;

a shell mounted on one of the connector units, the shell having a number of tabs projecting therefrom, the number and locations of the tabs being selectable; and a set of switches are mounted on a base adjacent the other connector, the switches being engagable by the tabs so that a status of the switches represents the number and position of the tabs, the switches thereby generating electrical signals corresponding to the selectable number and positions of the tabs.

11. A connector assembly having a first connector unit for carrying a plurality of conducting sockets and a second connector unit have a plurality of conducting pins for mating engagement with the sockets, characterized by:

an identifying member mounted to one of the connector units, the identifying member having features which may be arranged in a plurality of different unique configurations; and a plurality of sensor units operatively engagable with the features when the pins are mated with the sockets, the sensor units generating signals corresponding the configuration of the features.

* * * * *